US007322386B2

(12) United States Patent
Holm

(10) Patent No.: US 7,322,386 B2
(45) Date of Patent: Jan. 29, 2008

(54) COLLAPSIBLE FUNNEL

(76) Inventor: Jens Peder Holm, Rosenvænget 12, Harboøre (DK) DK-7673

( * ) Notice: Subject to any disclaimer, the term of this patent is extended or adjusted under 35 U.S.C. 154(b) by 0 days.

(21) Appl. No.: 10/576,750

(22) PCT Filed: Oct. 19, 2004

(86) PCT No.: PCT/DK2004/000715

§ 371 (c)(1),
(2), (4) Date: Sep. 11, 2006

(87) PCT Pub. No.: WO2005/037705

PCT Pub. Date: Apr. 28, 2005

(65) Prior Publication Data

US 2007/0079897 A1 Apr. 12, 2007

(30) Foreign Application Priority Data

Oct. 20, 2003 (DK) ..... 2003 01537

(51) Int. Cl.
*B65B 39/00* (2006.01)

(52) U.S. Cl. ..... 141/338; 141/337; 141/340

(58) Field of Classification Search ..... 141/331–342
See application file for complete search history.

(56) References Cited

U.S. PATENT DOCUMENTS

| | | | | | |
|---|---|---|---|---|---|
| 1,420,039 | A | * | 6/1922 | Horstkotte | 141/338 |
| 1,430,691 | A | * | 10/1922 | Self et al. | 141/337 |
| 1,461,654 | A | * | 7/1923 | Haessler | 141/338 |
| 1,538,171 | A | * | 5/1925 | Dailey | 141/338 |
| 1,563,005 | A | * | 11/1925 | Allee | 141/338 |
| 6,152,198 | A | * | 11/2000 | Nguyen | 141/337 |

* cited by examiner

*Primary Examiner*—Timothy L. Maust
(74) *Attorney, Agent, or Firm*—James Creighton Wray; Clifford D. Hyra

(57) ABSTRACT

A funnel for pouring liquid into a receptacle is collapsible and is stored in the receptacle when not in use. The funnel is automatically unfolded upon opening a receptacle lid. The funnel has no risk of unfolding in the receptacle. A tube fixed to a base plate includes displaceable means that are fastened to the lid. The tube is terminated at the top with an arrester for securing the displaceable means. The foldable funnel is disposed inside the existing receptacle, and the funnel is unfolded as soon as the lid is lifted. The opened lid is disposed at the side of the funnel completely outside the funnel circumference so as not to interfere with filling. Placing the lid upon the tube, centering the lid on the funnel and pushing downward closes the receptacle and folds the funnel, which disappears downward into the receptacle.

13 Claims, 7 Drawing Sheets

Fig. 6a
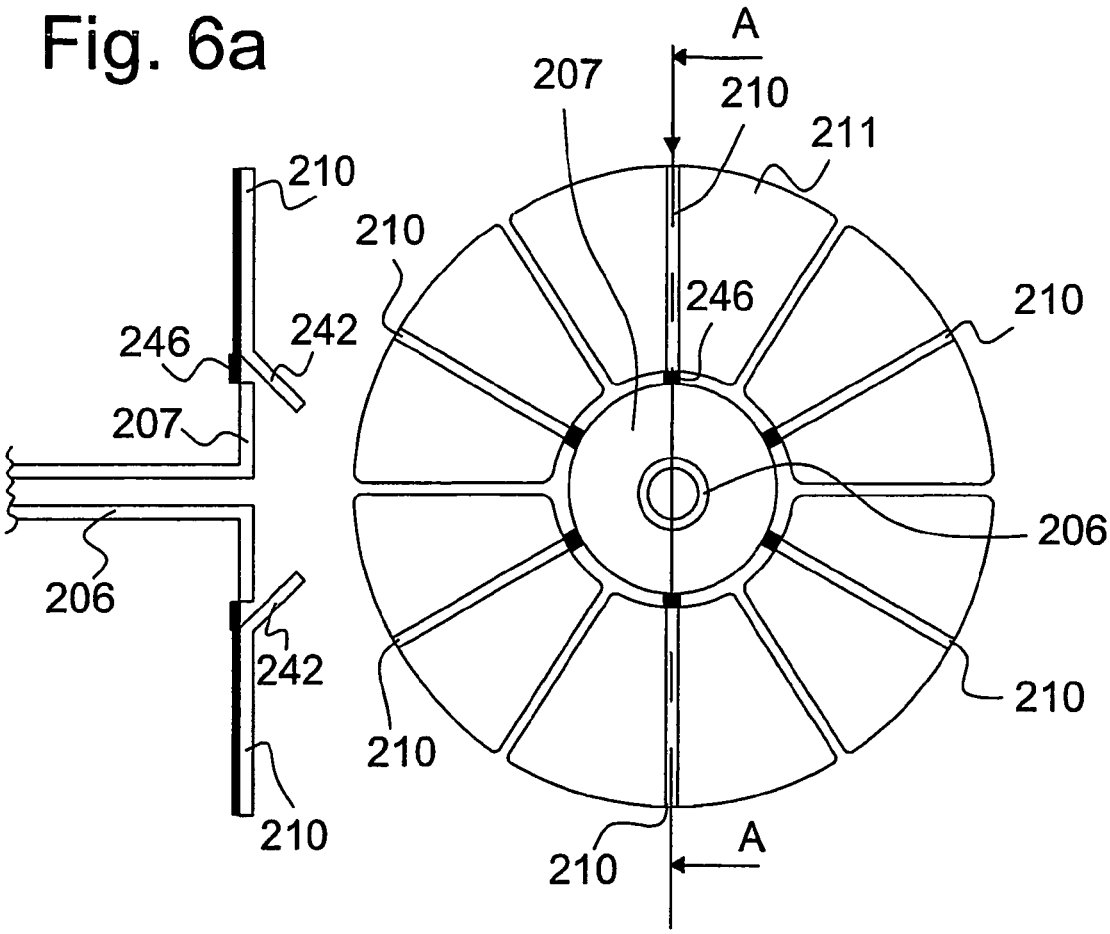
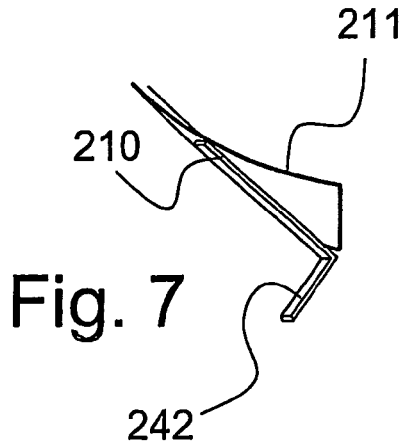
Fig. 7

COLLAPSIBLE FUNNEL

This application claims the benefit of Danish Application No. PA 2003 01537 filed Oct. 20, 2003 and PCT/DK2004/000715 filed Oct. 19, 2004, which are hereby incorporated by reference in their entirety.

BACKGROUND OF THE INVENTION

The present invention concerns a funnel for placing in a receptacle for pouring liquid into the receptacle, primarily in connection with pouring liquids from cans or bottles, where the funnel is collapsible, where the funnel is stored in the receptacle when not in use, where the funnel is unfolded at the opening of a receptacle lid, where the receptacle lid is connected with means for pulling up the funnel from the receptacle causing the funnel to be automatically unfolded, where the means for pulling up is connected with a base plate.

Such a funnel is known from U.S. Pat. No. 5,857,504, disclosing a collapsible funnel with associated movable rod extending inside the funnel and is connected to a screwcap, where the movable rod is pushed down into the receptacle through a filling stub when the funnel is not in use. The folding funnel is to be pulled out of the receptacle before use for automatic unfolding for use with the spout of the receptacle for filling liquid, particularly if the movable rod together with the lid exposes the funnel opening for facilitating liquid filling.

The movable rod, however, has a length greater than the funnel itself, whereby the length of the rod determines how great depth there is to be in the receptacle in order that the funnel can be used. In many receptacles, a liquid filter is provided under the filling stub, and this filter is perhaps to be removed due to the long rod. As the funnel is disposed freely in a receptacle, there is a possibility that the funnel itself will slide down under the lower edge of the stub, whereafter the funnel can be unfolded in the receptacle. A subsequent removal of the funnel may be impossible. Another drawback may be that by loading an e.g. can supported at the edge of the funnel, the funnel may be pushed down into the receptacle and liquid may be spilled, causing a fire hazard if the liquid is flammable.

SUMMARY OF THE INVENTION

It is the purpose of the invention to provide a collapsible funnel that may be placed in a receptacle and readily used, where there is no risk that the funnel is unfolded in the receptacle, and where the funnel is part of a unit which is simultaneously a liquid filter.

This may be achieved with a funnel as that described in the introduction, if the means for pulling up are formed by a tube fixed to the base plate, the tube including displaceable means that are fastened to the lid, and that tube is terminated at the top with arrester means for securing the displaceable means.

Hereby may be achieved a very efficient collapsible funnel that may be used advantageously for filling e.g. petrol on lawn mowers or windshield washer fluid on cars, where this foldable funnel may efficiently be disposed inside the existing receptacle, and where the funnel may be unfolded effectively as soon as the lid is lifted off. Since the lid is connected with the displaceable means, the lid maybe disposed on the side of the funnel and thereby completely outside the circumference of the funnel, whereby the lid will not in any way interfere with filling liquid. Closing of the receptacle will occur by the lid being placed upon the tube at the centre of the funnel and subsequent pushing downwards with the lid, whereby the funnel is folded together and disappears down into the receptacle.

The displaceable means may be formed by a weight contained in the tube, where a pliable or bendable connecting member is fastened to the weight and to the lid. Hereby is achieved that the pliable or bending connecting member allow complete removal of the lid while filling occurs, while the pliable or bending connecting member ensures that the lid does not disappear but stays close by. The pliable connecting member may advantageously be formed of e.g. a piece of steel wire, or maybe a piece of nylon cord, where the weight provided in the tube ensures retracting of cord or wire when the lid is put on.

The displaceable means may alternatively be formed of a rod that is contained in the tube, where the rod is terminated with a hinge member, where the hinge member interacts with the top end of the tube. Hereby is achieved a more rigid connection in the shape of a rod, where the hinge member allows that this rod is laid down to the side in the completely drawn out condition, whereby the lid again comes outside the circumference of the funnel itself.

The hinge member may contain a ball fastened to the rod, where the ball interacts with the end of the tube, and where the end of the tube includes slots for accommodating the rod. Hereby is achieved that the rod may be turned in any direction and may interact with one of the slots of the tube, whereby the rod may be laid entirely down to the side.

In the folded state, the funnel may be pushed down into a liquid filter that may be provided in the receptacle. Hereby may be achieved complete control of as to where the funnel is disposed when folded in the receptacle, and at a functional failure of the funnel, the entire internal liquid filter may be removed, thus removing the funnel from the receptacle at the same time. Using the liquid filter is particularly required if a previously fitted liquid filter is to be removed for making space for the funnel. Hereby may be ensured that the same filter function is continued, but now by means of the filter surrounding the funnel on all side and at the bottom.

The liquid filter may be designed with sealing means interacting with the stub of the receptacle which is designed with a collar, and where liquid filter forms or is provided with an annular sealing around the collar of the stub of the receptacle. Hereby may be achieved than the liquid filter forms its own sealing against the receptacle collar. This will be suitable if the receptacle e.g. includes a very volatile liquid like petrol, as evaporation is hindered thereby.

The liquid filter may include an annular recess at the top end of the filter, where the recess can engage corresponding projections on the funnel, whereby the funnel may be secured during use. Hereby may be attained that the funnel is unmoved in unfolded state, and that the funnel can e.g. withstand a can bearing on it during pouring without the funnel thereby being pushed down into the receptacle.

In a first alternative embodiment, close to its top end, the liquid filter may include an annular bayonet socket that may engage a corresponding bayonet joint on the funnel, whereby the funnel is secured during use. Hereby is achieved a stable locking of the funnel implying elimination of a risk that a funnel may capsize or fold and petrol may possibly be spilled and ignited, in the worst case.

In another alternative embodiment, close to its top end, the liquid filter may include an internal thread that may engage a corresponding external thread on the funnel, whereby the funnel may be secured during use. Also, hereby may be achieved a stable locking, where a person manipulating the funnel by tightening the thread is provided great safety for the funnel being secured before filling is commenced.

The top of the liquid filter may form a collar that may engage the lid of the funnel when the funnel is contained in folded state in the liquid filter. Hereby may be achieved an efficient closing of the receptacle, whereby evaporation of volatile liquids is achieved.

The filter might contain a central partly through going rod, which rod is placed partly in the tube, where the rod under the filter is connected to floating means, where the top of the rod indicates the liquid level of the receptacle. Hereby, may be achieved an efficient indication of the liquid level during the filling of liquid into the receptacle. The rod will also during faulting the funnel into the filter by pressing it down, the rod will govern the base plate in direction of the centre of the filter, and as such when the funnel reaches the bottom of the filter ensure that the base plate discentrally placed inside the filter which by the next opening of the filter assures an efficient and uncomplicated opening of the funnel The funnel can comprise spokes, which spokes support plumes between, where the spokes are hinged to the base plate by hinging means. Hereby, can be achieved a very effective funnel which might be light weight because the spokes and the plumes could be made of a plastic material. The spokes might be hinged to the base plate. It can be assured that the spokes are correctly placed during folding and unfolding of the funnel, and where the unfolding takes place by a turning of the hinging means. By producing the hinging means as a plastic film directly by the production of spokes and base plate, the hinging means can be a plastic film placed between the base plate and the spoke. Hereby, is achieved a very cheap and very effective production method for most of the components for the funnel.

The spokes might contain extensions, which extensions are folded towards the wall of the filter, which filter at the top comprises a surrounding constriction, which constriction cooperates with the spokes extensions by forcing the extensions in radial direction towards the central axis of the filter for unfolding the funnel by pulling the funnel upwards. Hereby, is achieved a very effective unfolding and folding method for the funnel. The necessary forces for unfolding the funnel is only needed for pulling the funnel the last few millimeters to the top of the filter. This means that it could be ensured that the spokes are outside the filter before they start opening. The use of the constriction in the top of the filter is also securing the funnel in the unfolded position where a folding can be started after the funnel has started its movement downwards into the filter, so the extensions of the spokes are no longer in contact with the constriction.

In the following, the invention is explained from the drawings where:

BRIEF DESCRIPTION OF THE DRAWINGS

FIG. 6 shows a top view of the same embodiment as FIG. 5,

FIG. 7 shows a section of a possible embodiment as shown in FIGS. 5 and 6.

DETAILED DESCRIPTION OF THE PREFERRED EMBODIMENTS

Figure 1:
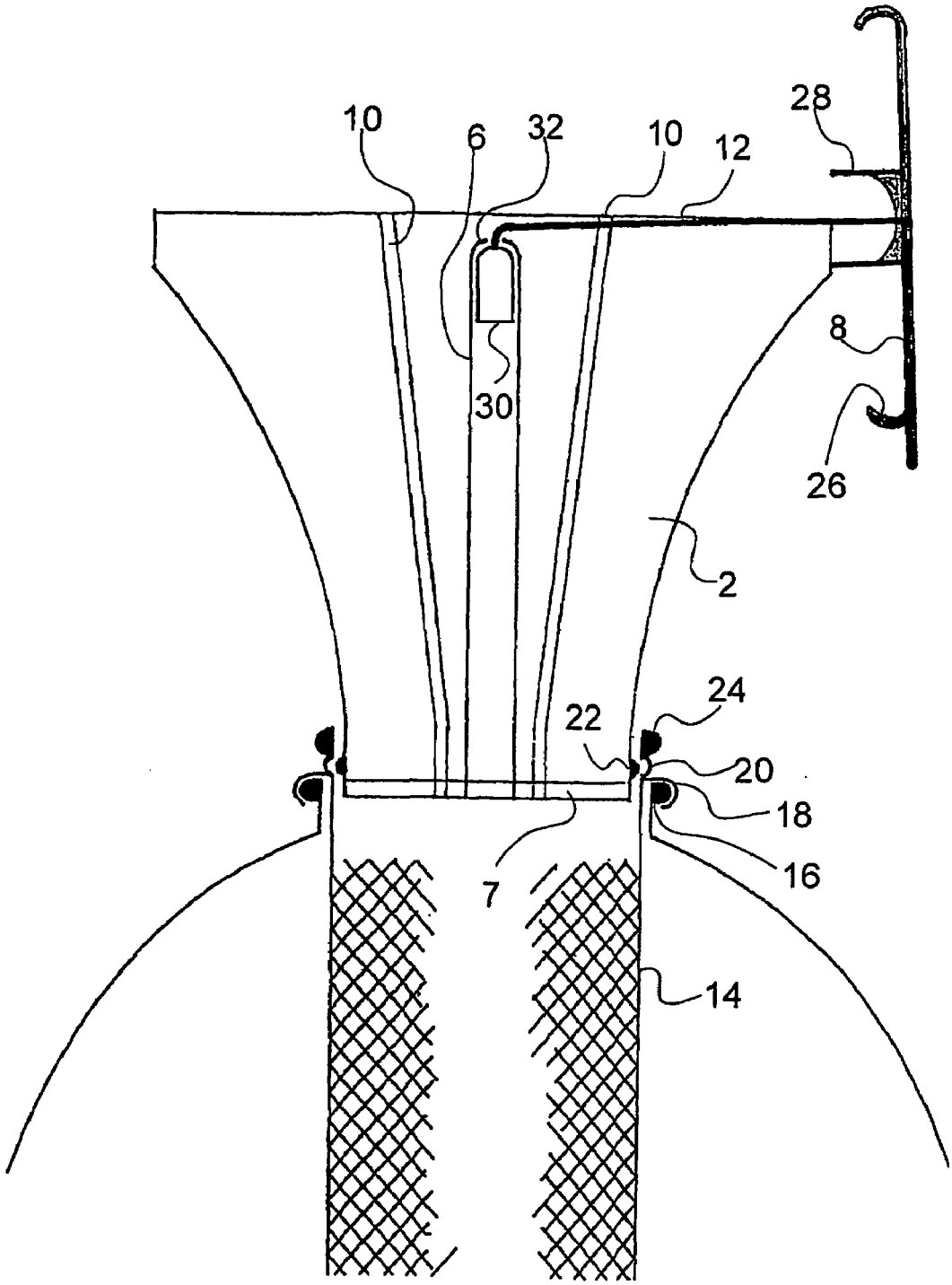
FIG. 1 shows section through a first possible embodiment.

FIG. 1 shows a possible embodiment of the invention with a funnel 2 interacting with a receptacle 4, where the funnel includes a tube 6 fixed on a base plate 7, where the funnel is connected to a lid 8, where the funnel has mechanical reinforcing elements 10, and where the lid 8 is connected to the tube 6 via a connecting member 12. The funnel 2 interacts with a liquid filter 14 interacting with a receptacle collar 16 at the top, as the liquid filter has a collar 18 fitting tightly around the receptacle collar 16. Also, the upper edge of the receptacle includes a clearance 20 that interact with a projection 22 on the funnel, whereby the funnel becomes fixed in the unfolded condition. At the top, the filter 14 has a collar 24 interacting with closure edge 26 on the lid 8. Simultaneously, the lid has a central projection 28 interacting with upper edge 32 of the tube 6. Inside the tube 6 is provided a weight 30 performing retracting of the connecting member 12 if the lid is put on. The connecting member 12 may be provided as a cord, e.g. a steel wire, or a nylon cord or other pliable material.

Placing the lid 8 over the tube 6 will imply that the funnel 2 is folded and pressed down into the liquid filter 14. Hereby the funnel 2 is secured in the liquid filter, and there is no possibility that the funnel can be unfolded down in the receptacle, a situation arising if the connecting element 12 is broken, as the funnel may then be freely pushed down into the receptacle. Simultaneously, the liquid filter 14 has the advantage that if a liquid filter has already been mounted in the receptacle, and this is necessarily to be removed for providing space for the funnel 2, the filter 14 can take over this function automatically. If the receptacle has space enough for accommodating the funnel at the outset, it will only be an advantage to introduce an extra liquid filter. Irrespectively whether the liquid that is to be stored in the receptacle is petrol for e.g. a lawn mower or windshield washer liquid for a car, or, if the case is pouring liquid from one receptacle to another, it is suitable that contaminating particles are prevented from access to the receptacle to the greatest possible extent.

Figure 2:
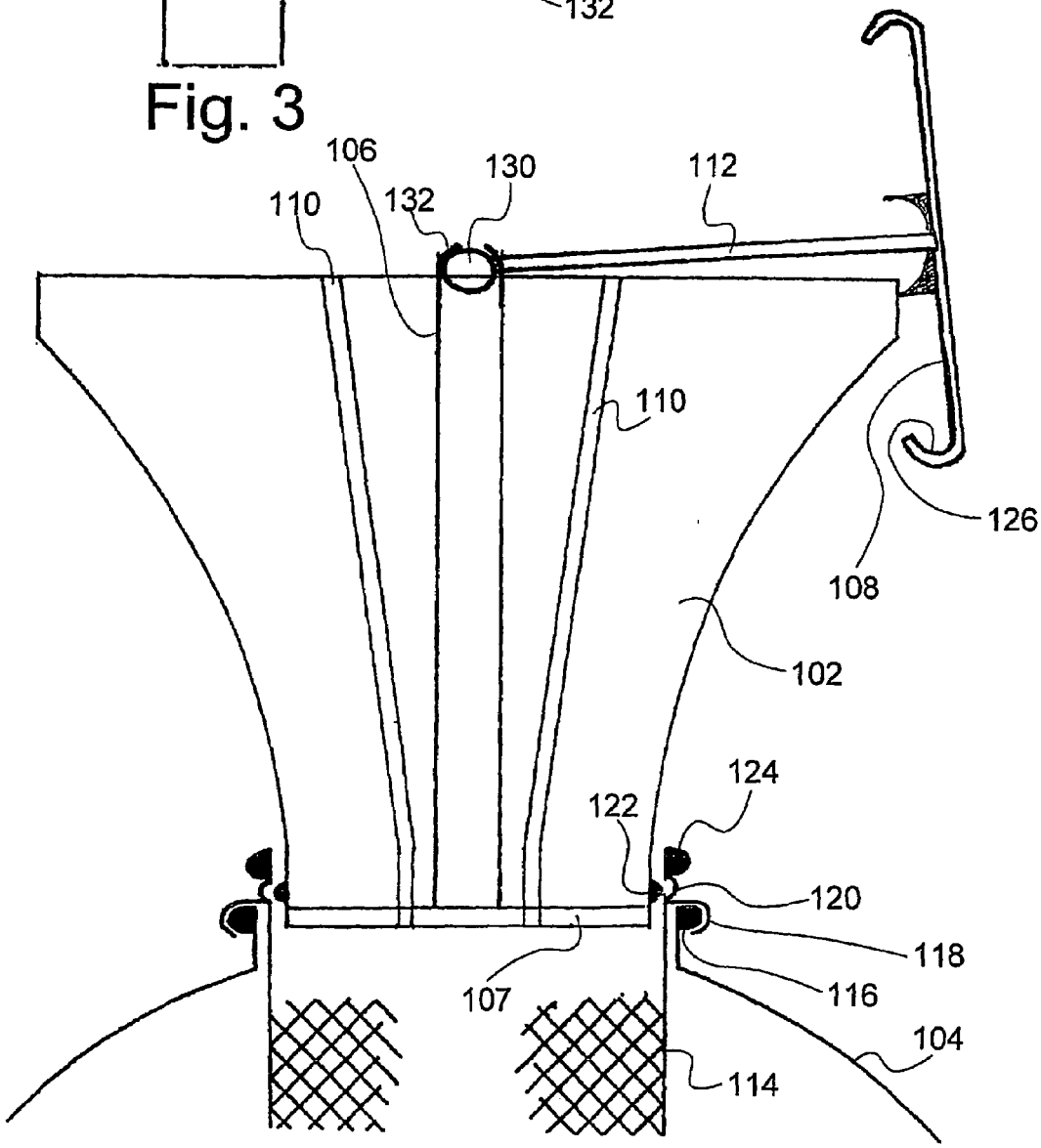
FIG. 2 shows a section through a second possible embodiment.

On FIG. 2 is shown an alternative embodiment for a funnel 102 that interacts with a receptacle 104, where an internal tube 106 is fastened to a base plate 107, where the tube 106 is mechanically connected with a lid 108 by a connecting rod 112, and where the funnel includes reinforcing elements 110. Inside the receptacle 104 there is shown a liquid filter 114. This liquid filter interacts with the upper edge 116 of the receptacle with a turned-in collar 118. Also, the liquid filter has a clearance 120 for receiving a projection 122 provided at the lower circumference of the funnel for securing the latter. At the top, the liquid filter 114 has a collar 124 interacting with the lid 108, where the lid has a closure edge 126.

The connecting member 112 is fastened onto a hinge member 130 which is designed as a ball, where the ball and the hinge member 130 interact with the end 132 of the tube 106.

Figure 3:
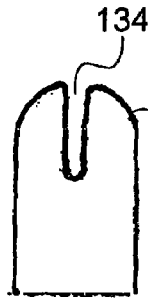
FIGS. 3 and 4 show enlarged details of FIG. 2.
Figure 4:
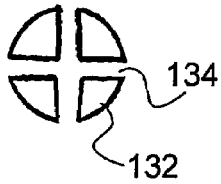

FIGS. 3 and 4 show in details the design of the end 132 of the tube 106, consisting of four projections that are separated by slots 134, where the slots are designed to accommodate the connecting member 112 so that the tube 106 can be laid down on the side of the funnel 102.

Figure 5:
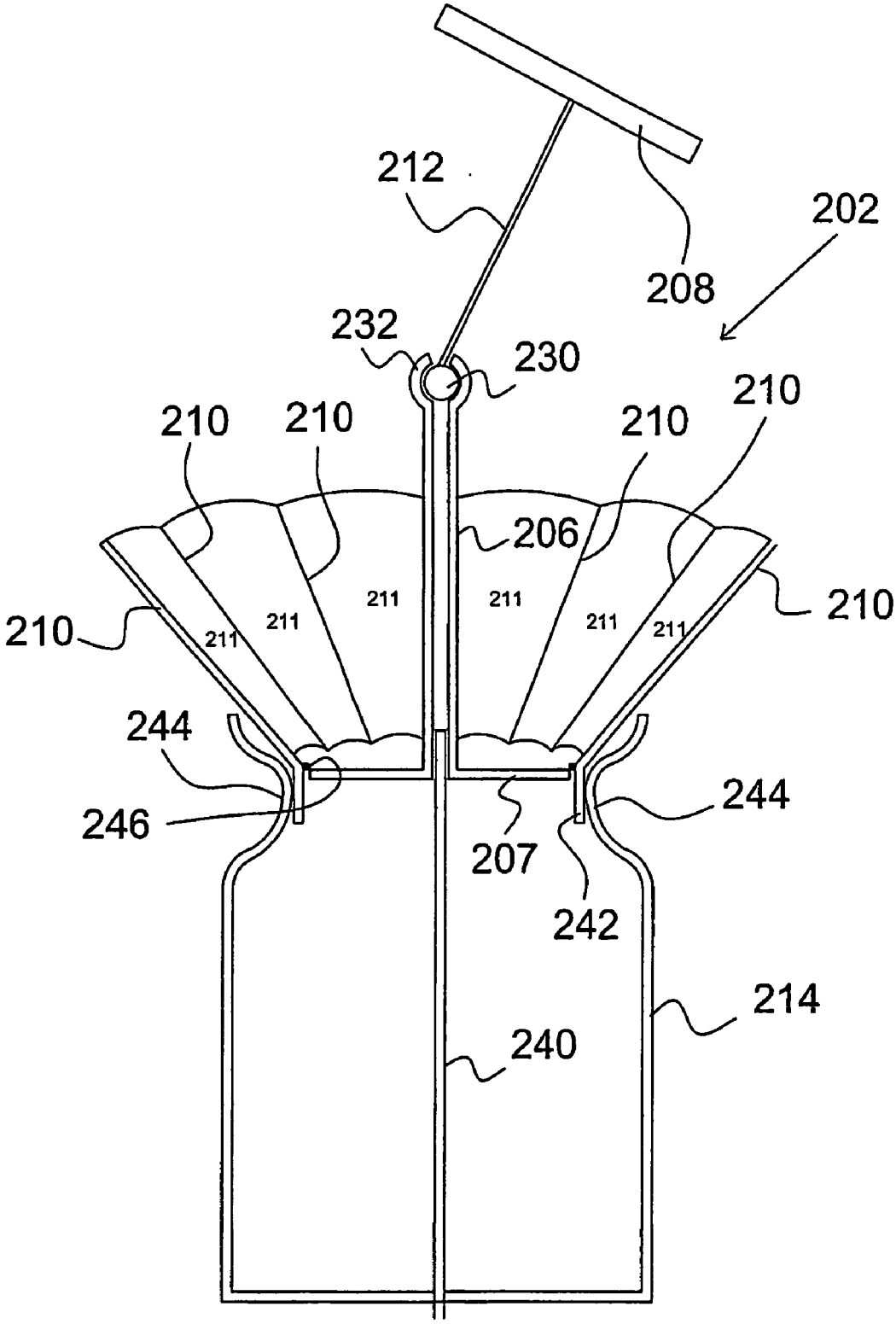
FIG. 5 shows a section through a third possible embodiment.

FIG. 5 shows a section through a third possible embodiment of the funnel 202 where an internal tube 206 is fastened to a base plate 207 where the tube 206 is mechanically connected with a lid 208 by a connection rod 202. And where the funnel includes spokes 210, which spokes 210 support plumes 211. The funnel 202 comprises a liquid filter 204. The connection rod 212 is fastened into a hinge member 230 which is designed as a ball where the ball and the hinge member 230 interact with the end 232 of the tube 206. Inside the tube 206, is placed a central rod 240 which rod is through going through the filter 214. The rod 240 might be slidable in the tube 206 and through an opening at the bottom of the filter 214. Underneath the filter 214, the rod 240 might be connected to not-shown buoyancy members which buoyancy member will pull the rod 240 upwards depending of the liquid level in the surrounding receptacle.

The rod 240 might in be placed in a not central opening in the bottom of the filter 214, without cooperating with the tube 206. The rod 240 might be connected by special connection means to buoyancy means placed beside or around the filter 214, in order to let the top of the rod 240 indicate the correct liquid level in the receptacle.

In operation, the funnel shown in FIG. 5 will be easy to fold by help of the lid 208 and the connection means 212 which can be pushed downwards into the tube 206. Pressing the lid further downwards will at a certain moment influence the base plate 207 and move that base plate 207 downwards. The constriction 244 interacts with the outside of the spokes 210 which are pressed simultaneously towards the centre of the funnel which is folded with a reduction of the diameter so that the whole funnel now can be pressed downwards into the filter 214. By pressing down the funnel, their connection means 212 and ball means 230 will interact with the rod 240 and press this rod downwards. This will press a buoyancy element down under the liquid level and as such and upwards acting force will act on rod 240. At the end, the lid 208 can be connected to the opening of the filter 214 by connecting means.

FIG. 6 shows the funnel from FIG. 5 seen from a top view. In the center is shown the top of the tube 206, and also the base plate 207 is seen from this top view. Spokes 210 are connected to the base plate 207 by hinging means 246, and between spokes 210 are placed plumes 211. The plumes 211 may for example be manufactured from a nylon-based material.

On FIG. 6*a* is shown a side view of the funnel from FIG. 6. Spokes 210 and extensions 242 are seen together with hinging means 246 connected to a base plate 207. The base plate 207 is connected to a tube 206. The connection between the spokes 210 and the hinging means might comprise a snap functions that is activated by unfolding the funnel for keeping the funnel unfolded until a central force at the tube 206 the base plate 207 is pressing the funnel 202 downwards for folding. The spokes 210 might have a curved form for keeping the funnel 202 unfolded in use.

FIG. 7 shows spokes 210 and extensions 242 and alternative plumes 211 now in a curved form.

Figure 8:
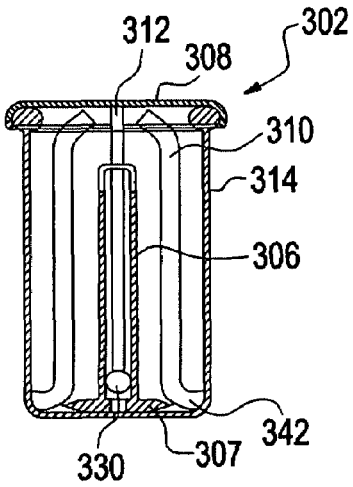
FIG. 8 shows a section through a fourth possible embodiment for a folded funnel.

FIG. 8 shows a cut through a fourth possible funnel 302 which funnel is folded and placed totally inside a filter 314. Inside the filter 314 is seen the tube 306 and the ball member 330 is seen at the bottom. The lid 308 is seen at the top which lid 308 is connected to the connecting means 312. Spokes 310 is also seen inside the filter 314 and the spokes' extensions 342 are seen at the bottom. The extensions 342 are in close contact to the base plate 307.

Figure 9:
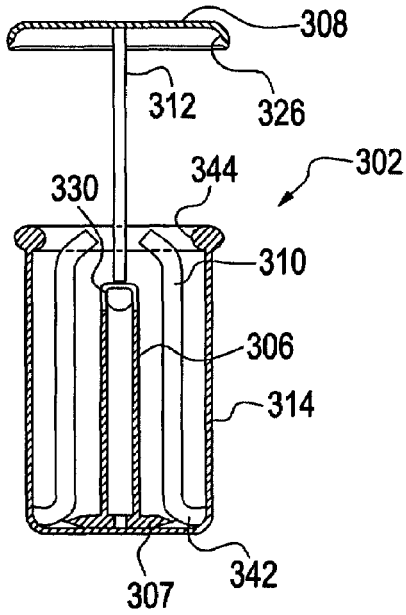
FIG. 9 shows the same embodiment as FIG. 8 but partly opened.

FIG. 9 shows the same embodiment but now partly opened. The primary difference is now that the lid is pulled upwards and the connection means 312 are now pulled out from the tube 306. Also the ball member has been moved from the bottom of the filter 314 till a top position. The spokes 310 and the extensions 342 and the base plate 307 are still in the same position as in FIG. 8.

Figure 10:
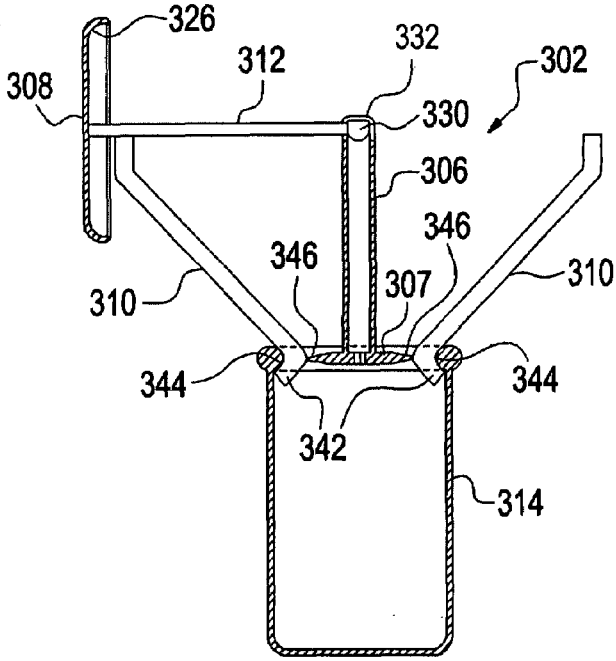
FIG. 10 shows the same embodiment as FIG. 9 unfolded.

FIG. 10 shows the same embodiment as in FIG. 8 and FIG. 9, but now fully opened. The lid 308 and the connection rod 312 are now bent to the side by rotating the ball member 337 inside the top 332. The slits are not shown inside the top element 332 for the connection rod 312. The spokes 310 are unfolded, they are connected to the base plate 307 by hinging means 346. The spokes have extensions 342 cooperating with the constriction 344 where the contact between the extension 342 and their constriction 334 leads to unfolding of the spokes 310.

Figure 11:
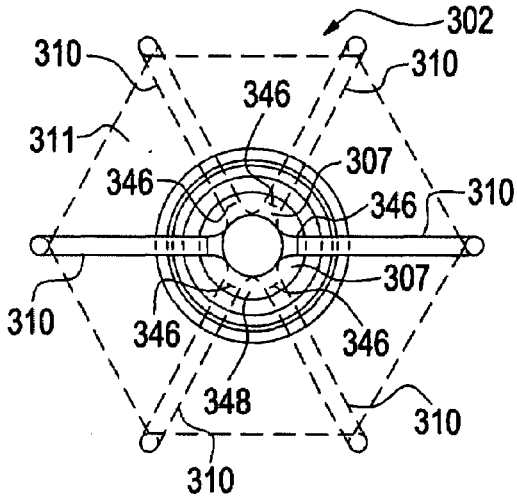
FIG. 11 shows the embodiment as in FIG. 10 seen from the top.

FIG. 11 shows the same invention as FIGS. 8, 9 and 10 but here seen as a top view. Spokes 310 are by hinging means 346 connected through a base plate 307. Between spokes 310 are shown glooms 311. Between the hinging means, the spokes 310 and the base plate 307 are openings for letting your fluids flow downwards into the filter 314 as shown on FIG. 10.

Figure 12A:
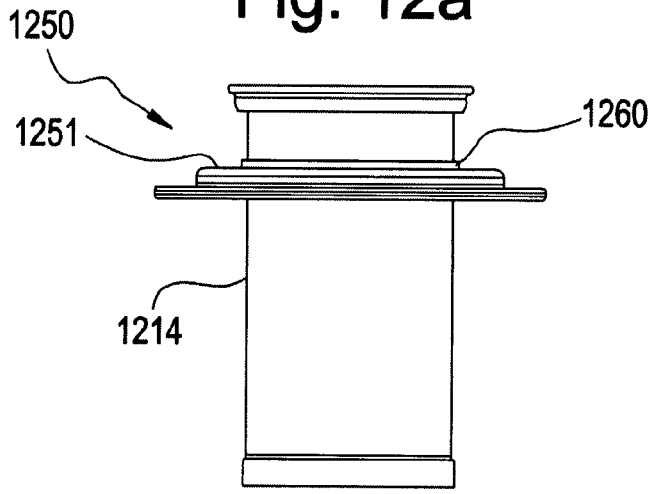
FIG. 12*a* shows an embodiment of a funnel according to the invention, equipped with a ring.

FIG. 12*a* shows a possible embodiment of the invention where the liquid filter 1214 is equipped with a ring 1250. The liquid filter 1214 has a protrusion 1260, which interacts with the upper edge 1251 of the ring 1250.

Figure 12B:
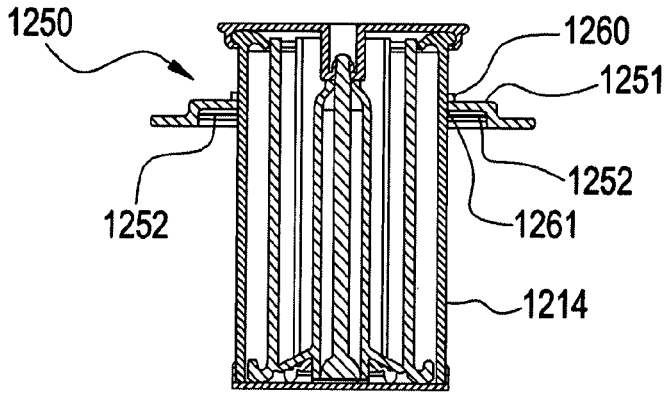
FIG. 12*b* shows a cross sectional view of the same embodiment as shown in FIG. 12*a*.

FIG. 12*b* shows a cross sectional view of the same embodiment as shown in FIG. 12*a*. The ring 1250 is provided with a recess 1252, which interacts with a projection 1261 on the liquid filter 1214.

The ring 1214 may be manufactured in different sizes in order to fit any given opening of a receptacle. The ring may further be exchangeable. It is, hereby, achieved that the funnel may be manufactured in a standard size and shape. If the liquid filter 1214 has a smaller cylindrical radius than the opening of the receptacle, then the liquid filter 1214 may be provided with a ring 1250 of a suitable size. The rings may be shaped in such a way that they can be mounted on the liquid filter 1214 at an oblique angle with respect to the cylinder axis of the liquid filter 1214. In this way, the funnel may be adapted to any given opening.

A funnel according to the invention may for example be used for filling windshield washer fluid on a car. However, since the different types and brands of cars have different types of receptacles for windshield washer fluid, the collapsible funnel may be sold together with a set of rings so that the funnel may be adapted to any given receptacle. Due to the low manufacturing cost of the rings 1250, this will not lead to a notable increase in the price of the finished product.

Figure 12C:
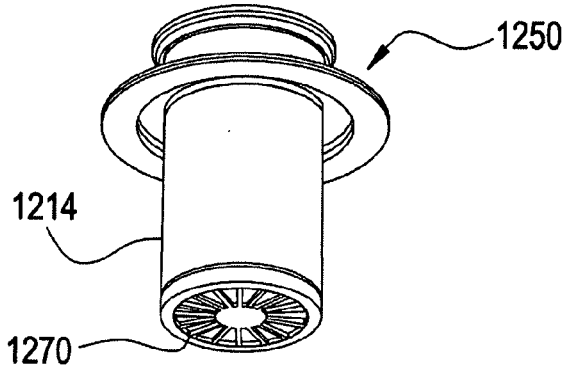
FIG. 12*c* shows the same embodiment as shown in FIGS. 12*a* and 12*b* in perspective.

FIG. 12*c* shows the same embodiment as shown in FIGS. 12*a* and 12*b* in perspective. At the bottom of the liquid filter 1214, a meshed filter 1270 is provided. It is, hereby, achieved that possible contaminants, for example small particles, may be collected and thus an eventual destruction of the liquid pump may be avoided. In another embodiment, the liquid filter 1214 may be a pipe with no filter at the bottom. Instead, the pipe may be provided with a stop-ring at the bottom, which will prevent the funnel from sliding down in the receptacle in which it is stored. Additionally, the rings 1250 may have an outer perimeter that is not ring-shaped, but instead have a polygonal edge.

Figure 13:
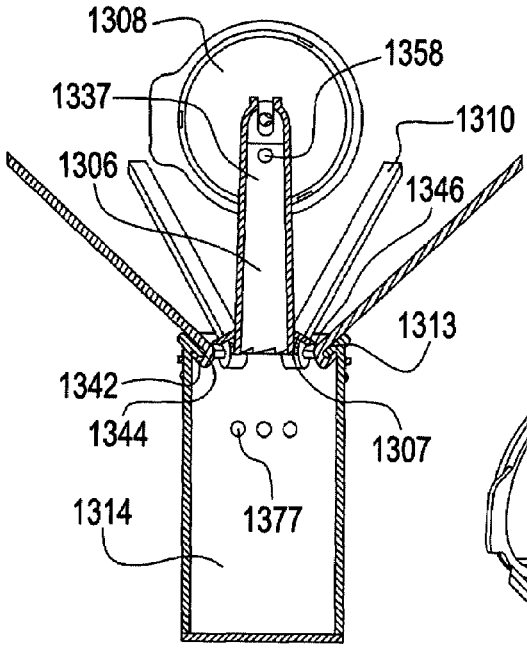
FIG. 13 shows a cut through of the same embodiment of a funnel as shown in FIG. 12, but without the ring.

FIG. 13 shows a cut through of the same embodiment of a funnel as shown in FIG. 12, but without the ring 1250. The funnel is displayed fully opened. The lid 1308 is connected to the tube 1306 with a connection rod (of which only the bottom is shown). The spokes 1310 are by hinging means 1346 connected to the base plate 1307. The upper part of the liquid filter 1314 comprises a protrusion 1313 that interacts with the extensions 1342 of the spokes 1310. The extensions 1342 cooperate with the constrictions 1344 where the contact between the extensions 1342 and their constriction 1344 leads to an unfolding of the spokes 1310 and a fixing of the spokes 1310 in the unfolded position. The liquid filter additionally contains air holes 1377. The air holes 1377 ensure that liquid may be filled into a receptacle using a funnel according to the invention at a higher rate because air may escape the receptacle while filling it with liquid. An additional air hole 1358 may be placed at the top of the tube 1306.

Figure 14:
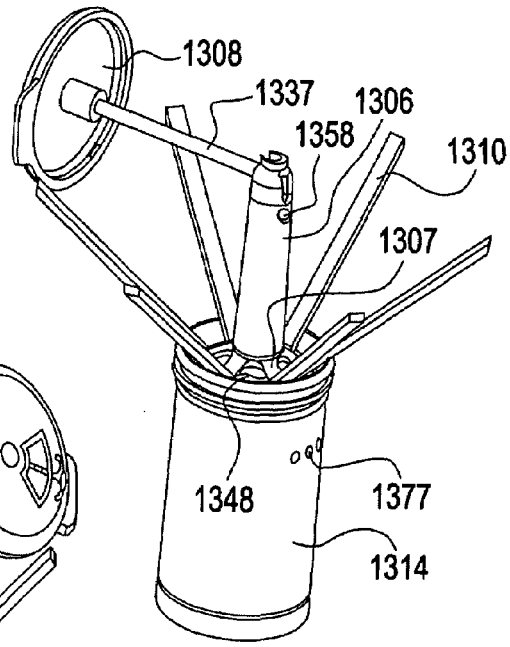
FIG. 14 shows the same embodiment of a funnel as shown in FIG. 13, where the funnel is displayed fully opened.

FIG. 14 shows the same embodiment of a funnel as shown in FIG. 13. The funnel is displayed fully opened. The lid 1308 is connected to the tube 1306 with a connection rod 1437. Between the hinging means, the spokes 1310 and the base plate 1307, there are openings 1348 for letting fluids flow downwards into the filter 1314.

Figure 15:
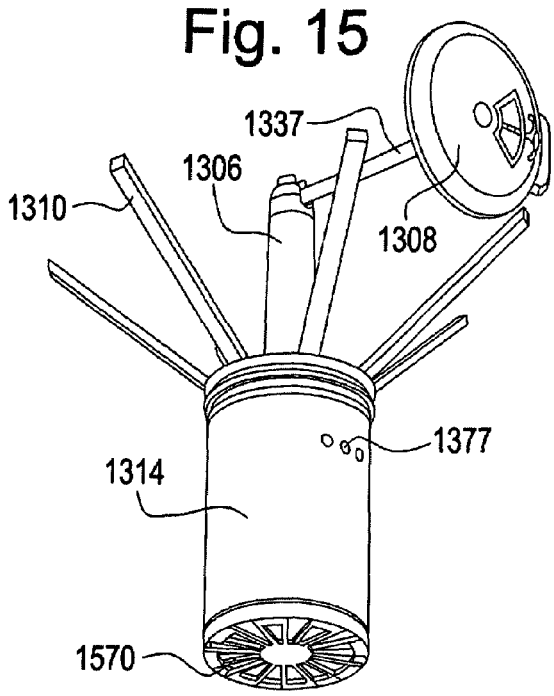
FIG. 15 shows the same embodiment of a funnel as shown in FIG. 14, but here viewed from a different angle.

FIG. 15 shows the same embodiment of a funnel as shown in FIG. 14 where the funnel is displayed fully opened, but here viewed from a different angle so that the meshed filter 1570 at the bottom of the liquid filter 1314 can be seen. The meshed filter 1570 ensures that possible contaminants in the liquid are prevented from entering the receptacle.

A funnel according to the invention may be manufactured from a material that is particularly suitable for usage in conjunction with any given liquid. A funnel for filling gasoline on for example a lawn mower may be manufactured from a different kind of material than a funnel that is used in a receptacle for wind shield washer liquid. The funnel may in an alternative embodiment be equipped with a special filter, which is specially designed for filtering of gasoline.

The invention claimed is:

1. Funnel for placing in a receptacle for pouring liquid into the receptacle, primarily in connection with pouring liquids from cans or bottles, where the funnel is collapsible, where the funnel is stored in the receptacle when not in use, where the funnel is unfolded at the opening of a receptacle lid, where the receptacle lid is connected with means for pulling up the funnel from the receptacle causing the funnel to be automatically unfolded, where the means for pulling up is connected with a base plate, characterised in that the means for pulling up are formed by a tube fixed to the base plate, the tube including displaceable means that are fastened to the lid, and that tube is terminated at the top with arrester means for securing the displaceable means.

2. Funnel according to claim 1, characterised in that the displaceable means are formed by a weight contained in the tube, where a pliable connecting member is fastened to the weight and to the lid.

3. Funnel according to claim 1, characterised in that the displaceable means are formed by a rod that is contained in the tube, where the rod is terminated with a hinge member, where the hinge member interacts with the top end of the tube.

4. Funnel according to claim 3, characterised in that the hinge member contains a ball fastened to the rod, where the ball interacts with the end of the tube, and that the end of the tube includes slots for accommodating the rod.

5. Funnel according to claim 1, characterised in that the funnel in folded state is pressed down into a liquid filter provided in the receptacle.

6. Funnel according to claim 1, characterised in that the liquid filter has sealing means interacting with the stub of the receptacle which is designed with a collar, and that liquid filter forms or is provided with an annular sealing around the collar of the stub of the receptacle.

7. Funnel according to claim 1, characterised in that the liquid filter is provided with an annular recess at the top end of the filter, where the recess can engage corresponding projections on the funnel, whereby the funnel is secured during use.

8. Funnel according to claim 1, characterised in that close to its top end, the liquid filter includes an annular bayonet socket that may engage a corresponding bayonet joint on the funnel, whereby the funnel is secured during use.

9. Funnel according to claim 1, characterised in that close to its top end, the liquid filter includes an internal thread that may engage a corresponding external thread on the funnel, whereby the funnel is secured during use.

10. Funnel according to claim 1, characterised in that the top of the liquid filter forms a collar that may engage the lid of the funnel when the funnel is contained in folded state in the liquid filter.

11. Funnel according to claim 1, characterised in that the filter contains a central partly through going rod, which rod is placed partly in the tube, where the rod under the filter is connected to floating means, where the top of the rod is indicating the liquid level of the receptacle.

12. Funnel according to claim 1, characterised in that the funnel comprises spokes, which spokes supports plumes there between, where the spokes are hinged to the base plate by hinging means.

13. Funnel according to claim 12, characterised in that the spokes contain extensions, which extensions are folded towards the wall of the filter, which filter at the top comprises a surrounding constriction, which constriction cooperates with the spokes extensions by forcing the extensions in radial direction towards the central axis of the filter for unfolding the funnel by pulling the funnel upwards.

* * * * *